US005848833A

United States Patent [19]

Margulies et al.

[11] Patent Number: 5,848,833

[45] Date of Patent: Dec. 15, 1998

[54] BIDIRECTIONAL LIGHTING SYSTEM

[75] Inventors: Stephen F. Margulies, Woodcliff Lake, N.J.; William Hirsch, Long Island City, N.Y.

[73] Assignee: Linear Lighting Corp., Long Island City, N.Y.

[21] Appl. No.: 560,020

[22] Filed: Nov. 17, 1995

[51] Int. Cl.[6] ..... F21S 1/02; F21S 1/04; F21V 1/00; F21V 13/00

[52] U.S. Cl. ..... 362/147; 362/240; 362/241; 362/242; 362/243; 362/260; 362/404

[58] Field of Search ..... 362/147, 240, 362/241, 242, 243, 260, 404, 148, 149, 150, 151

[56] References Cited

U.S. PATENT DOCUMENTS

| | | | |
|---|---|---|---|
| 2,514,049 | 7/1950 | Graham | 362/151 |
| 3,077,536 | 2/1963 | Garnett | 362/225 |
| 3,200,244 | 8/1965 | Meyer | 362/225 |
| 3,201,582 | 8/1965 | Siegel | 362/243 |
| 4,204,274 | 5/1980 | Luderitz | 362/239 |
| 4,310,876 | 1/1982 | Small | 362/298 |
| 4,415,957 | 11/1983 | Schwartz | 362/147 |
| 4,425,603 | 1/1984 | Courson | 362/222 |
| 4,450,513 | 5/1984 | Guggemos | 362/299 |
| 4,536,830 | 8/1985 | Wisniewski | 362/223 |
| 4,549,253 | 10/1985 | Totten | 362/364 |
| 4,683,526 | 7/1987 | Krosgrud | 362/346 |
| 4,809,147 | 2/1989 | Negishi | 362/347 |
| 4,876,633 | 10/1989 | Engel | 362/223 |
| 4,939,627 | 7/1990 | Herst | 362/299 |
| 4,974,138 | 11/1990 | Negishi | 362/347 |
| 5,032,959 | 7/1991 | Brass | 362/238 |
| 5,051,878 | 9/1991 | Ngai | 362/299 |
| 5,075,827 | 12/1991 | Smith | 362/221 |
| 5,111,370 | 5/1992 | Clark | 362/147 |
| 5,146,393 | 9/1992 | Crane | 362/260 |
| 5,160,193 | 11/1992 | Fabbri | 362/33 |
| 5,278,737 | 1/1994 | Luce | 362/147 |

FOREIGN PATENT DOCUMENTS

| | | | |
|---|---|---|---|
| 347700 | 12/1989 | European Pat. Off. | 362/225 |
| 3233820 | 3/1984 | Germany | 362/147 |

*Primary Examiner*—Ira S. Lazarus
*Assistant Examiner*—Matthew J. Spark
*Attorney, Agent, or Firm*—Natter & Natter

[57] ABSTRACT

A bidirectional lighting system includes a housing having a planar base and a stringer connected to end plates by a chassis. The chassis carries a bracket for light sockets and asymmetric reflectors. The edges of the base, the end plates and the stringer define a pair of windows. One light source and an associated asymmetric provide up light illumination through one of the windows and the other light source and its associated reflector provides wall wash illumination of an adjacent wall through the other window.

20 Claims, 6 Drawing Sheets

18
16
16
16
34
30
10
26
26
12
14
20
2
2
24

BIDIRECTIONAL LIGHTING SYSTEM

FIELD OF THE INVENTION

This invention relates generally to illumination systems and more particularly to a bidirectional room lighting system for providing both indirect up light illumination and adjunct wall wash illumination of a wall adjacent the fixture.

BACKGROUND HISTORY

The attributes of indirect lighting have been long recognized and include even distribution of illumination, reduction of distracting shadows, reduced glare and overall promotion of a healthy, stress free, work or leisure environment. Examples of up light indirect lighting systems are illustrated in the following U.S. Patents: U.S. Pat. No. 5,111,370 issued to CLARK, U.S. Pat. No. 5,075,827, issued to SMITH, U.S. Pat. No. 5,051,878, issued to NGAI, U.S. Pat. No. 4,939,627 issued to HERST, et al., U.S. Pat. No. 4,425,603, issued to COURSON, U.S. Pat. No. 4,450,513, issued to GUGGEMOS and U.S. Pat. No. 4,425,603, issued to COURSON.

A need was recognized, however, to provide additional illumination in many instances. Certain situations required wall wash illumination for decorative effects, for illumination of wall hangings, etc. and for supplementing the illumination of objects or work areas adjacent a wall.

Lighting fixtures capable of projecting light against a vertical wall for a wall wash illumination have also been known. Track lights and down lights which projected light toward walls have been utilized. Illustrated in U.S. Pat. No. 5,160,193, issued to FABBRI, et al. is a modular hospital room lighting system which included a down light module for wall illumination.

In U.S. Pat. No. 5,278,737 issued to LUCE, an up light fixture capable of illumination of a wall was disclosed. The LUCE fixture was incapable of illuminating an entire wall; only the portion of the wall above the fixture was illuminated. The LUCE fixture failed to provide a wall wash effect.

There was a need, therefore, to provide a single light fixture which could combine the attributes of indirect up light illumination as well as full wall wash illumination and which would be relatively low in cost and economical in operation.

SUMMARY OF THE INVENTION

In compendium, the present invention comprises a bidirectional lighting system which is operatively suspended beneath a light reflected ceiling. The system includes a fixture housing having a pair of illumination windows. The housing carries at least one light source associated with each window and a pair of asymmetric reflectors. One reflector is oriented for up light illumination through one window while the other reflector is oriented to project wall wash illumination through the other window.

The housing includes a generally planar base. A pair of end plates are positioned at opposite ends of the base and a stringer extends parallel to the base and between the end plates. Each window is defined by the stringer and a longitudinal edge of the base. A collar extends axially from each end plate for suspending the housing and for joining adjacent housings in a longitudinal row, if desired.

Each end plate carries a chassis which supports a bracket. The asymmetric reflectors are mounted to and span between the brackets of opposite end plates and project illumination from linear lighting elements connected to sockets carried by the brackets. The illumination is projected through the windows which are defined by the openings between the longitudinal edges of the base and the stringer and the end plates.

High efficiency ballast type power supplies are provided for the lighting elements for selectively providing up light, wall wash or combined up light and wall wash illumination. Each ballast is mounted to an angle iron which spans the base to provide structural reinforcement.

From the foregoing compendium, it will be appreciated that it is a consideration of the present invention to provide a bidirectional lighting system of the general character described which is not subject to the disadvantages of the background history aforementioned.

An aspect of the present invention is to provide a bidirectional lighting system of the general character described having a light fixture housing and which is suitable for simultaneously providing up light illumination and wall wash illumination both above and below the elevation of the housing.

A feature of the present invention is to provide a bidirectional lighting system of the general character described which is well adapted to employ economical high efficiency linear lighting elements and high efficiency power supplies.

Another consideration of the present invention is to provide a bidirectional lighting system of the general character described which is readily adaptable for economical low cost mass production fabrication.

To provide a bidirectional lighting system of the general character described which includes a plurality of light fixture housings readily adaptable for end to end structural and electrical interconnection is a further aspect of the present invention.

A further feature of the present invention is to provide a bidirectional lighting system of the general character described which is well suited for employment in varied applications and is capable of providing independent up light and wall wash illumination.

An additional consideration of the present invention is to provide a bidirectional lighting system of the general character described with efficient light distribution characteristics and which is well suited for employment in both office and industrial applications.

Another aspect of the present invention is to provide a bidirectional lighting system of the general character described which is capable of easy installation by relatively unskilled personnel.

Other considerations, features and aspects of the present invention in part will be obvious and in part will be pointed out hereinafter.

With these ends in view, the invention finds embodiment in certain combinations of elements, arrangements of parts and series of steps by which the said considerations, features and aspects and certain other considerations, features and aspects are attained, all with reference to the accompanying drawings and the scope of which is more particularly pointed out and indicated in the appended claims.

DESCRIPTION OF THE DRAWINGS

In the accompanying drawings in which is shown one of the various possible exemplary embodiments of the invention.

DESCRIPTION OF THE PREFERRED EMBODIMENT

Figure 1:
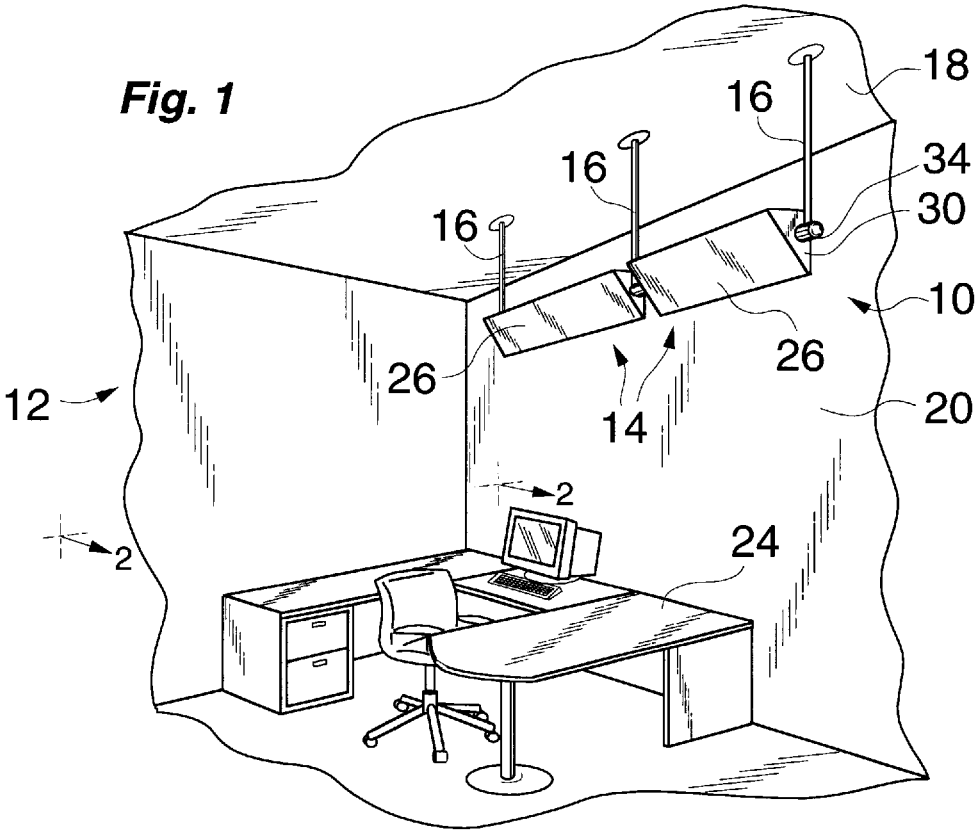
FIG. 1 is a perspective illustration of a typical room illuminated with a bidirectional lighting system constructed in accordance with and embodying the invention and showing a pair of interconnected light housings joined end to end and suspended from a ceiling.

Referring now in detail to the drawings, the reference numeral 10 denotes generally a bidirectional lighting system constructed in accordance with and embodying the invention. The lighting system 10 provides illumination for a typical room 12 and comprises one or more end to end interconnected fixture housings 14 which are suitably suspended by a plurality of hollow stems 16 from a light reflective ceiling 18.

The stems 16 serve not only to suspend the housings 14, but, in addition, one or more stems 16 are interconnected to electrical boxes which are anchored above the ceiling 18. The stems 16 thus provide a hollow conduit for electrical wiring. For optimal results, the ceiling 18 is preferably white and of relatively high reflectance, e.g. 80% and the fixture housings 14 are suspended approximately 18 inches beneath the ceiling 18.

As will be noted from an observation of FIG. 1, the fixture housings 14 extend along a longitudinal axis parallel to a vertical wall 20 which, in accordance with the present invention, will receive wall wash illumination from the lighting system 10. Positioned in the room, for the purpose of illustration only, is a desk having an upper surface which lies in a work plane 24.

In accordance with the invention, each fixture housing 14 includes a generally planar elongate base 26, preferably extruded of a suitable metal such as aluminum and which may be cut to lengths for providing fixture housings which will accommodate the various sizes of available high efficiency linear lighting sources or elements. The base 26 includes an outer face which receives a suitable surface treatment such as, an anodized satin finish. A plurality of channels 28 of rectangular cross section extend along the inner face of the base and which are symmetric about the longitudinal axis of the base. Adjacent each longitudinal edge of the base is an extruded "C" shaped channel 29. At the ends of the base 26, a pair of right triangle shaped, generally planar end plates 30 are secured. Each end plate 30 has a central circular aperture 32 within which a cylindrical extruded collar 34 is seated. The collar 34 interconnects a plurality of housings 14 in end to end relationship. A threaded end portion of each suspension stem 16 is engaged in a threaded aperture of each collar 34. Spring loaded end caps 35 are inserted in the open ends of the collars 34 at the ends of a row of interconnected housings 14. The collar 34 additionally includes a plurality of internal longitudinal ribs which provide "C" shaped channels within which connecting self tapping screws may be anchored as will be hereinafter described.

Figure 4:
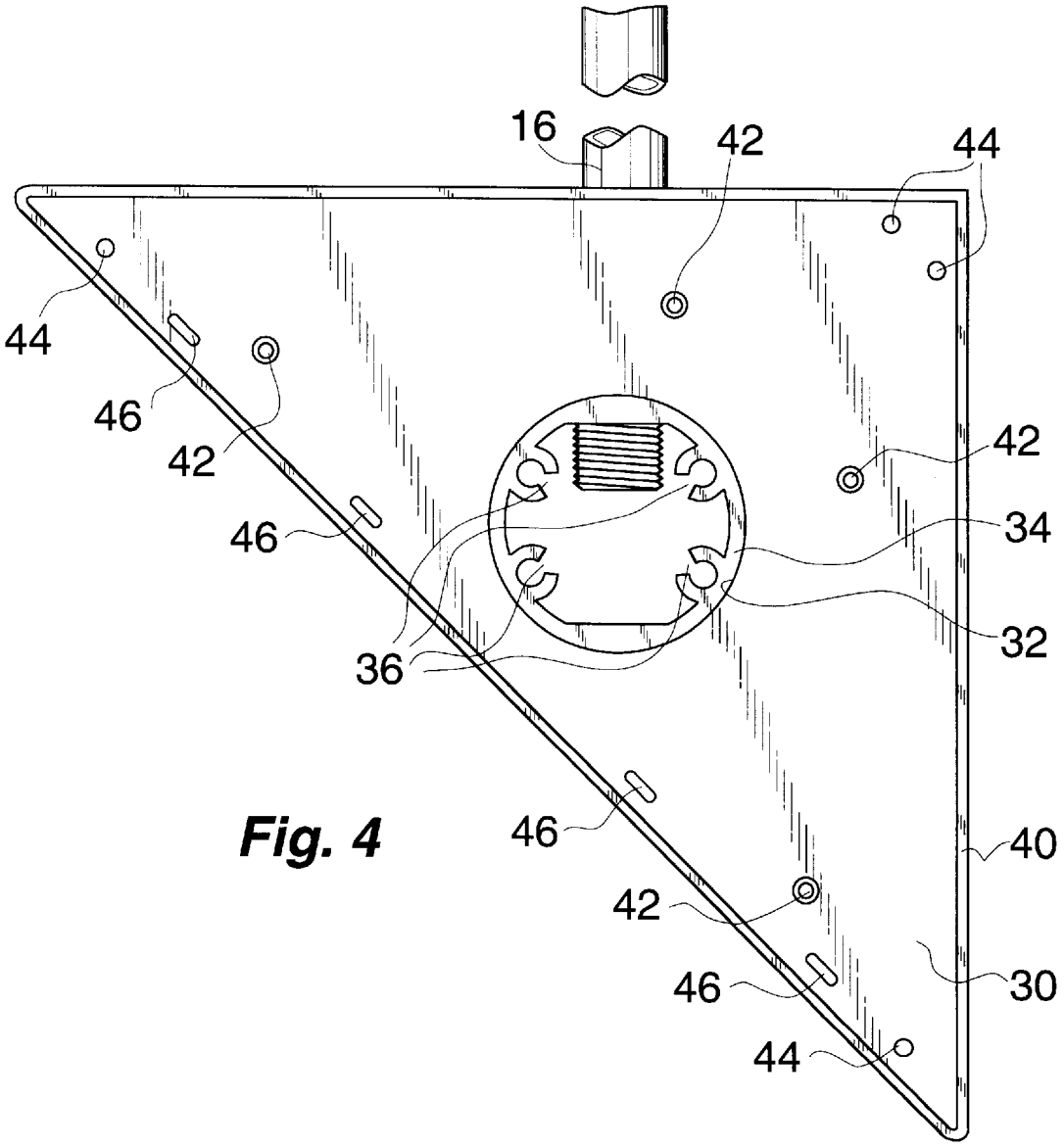
FIG. 4 is an enlarged scale auxiliary elevational view of a portion of the housing comprising an end plate and a support collar, the same being taken substantially along a plane 4—4 of FIG. 3.
Figure 5:
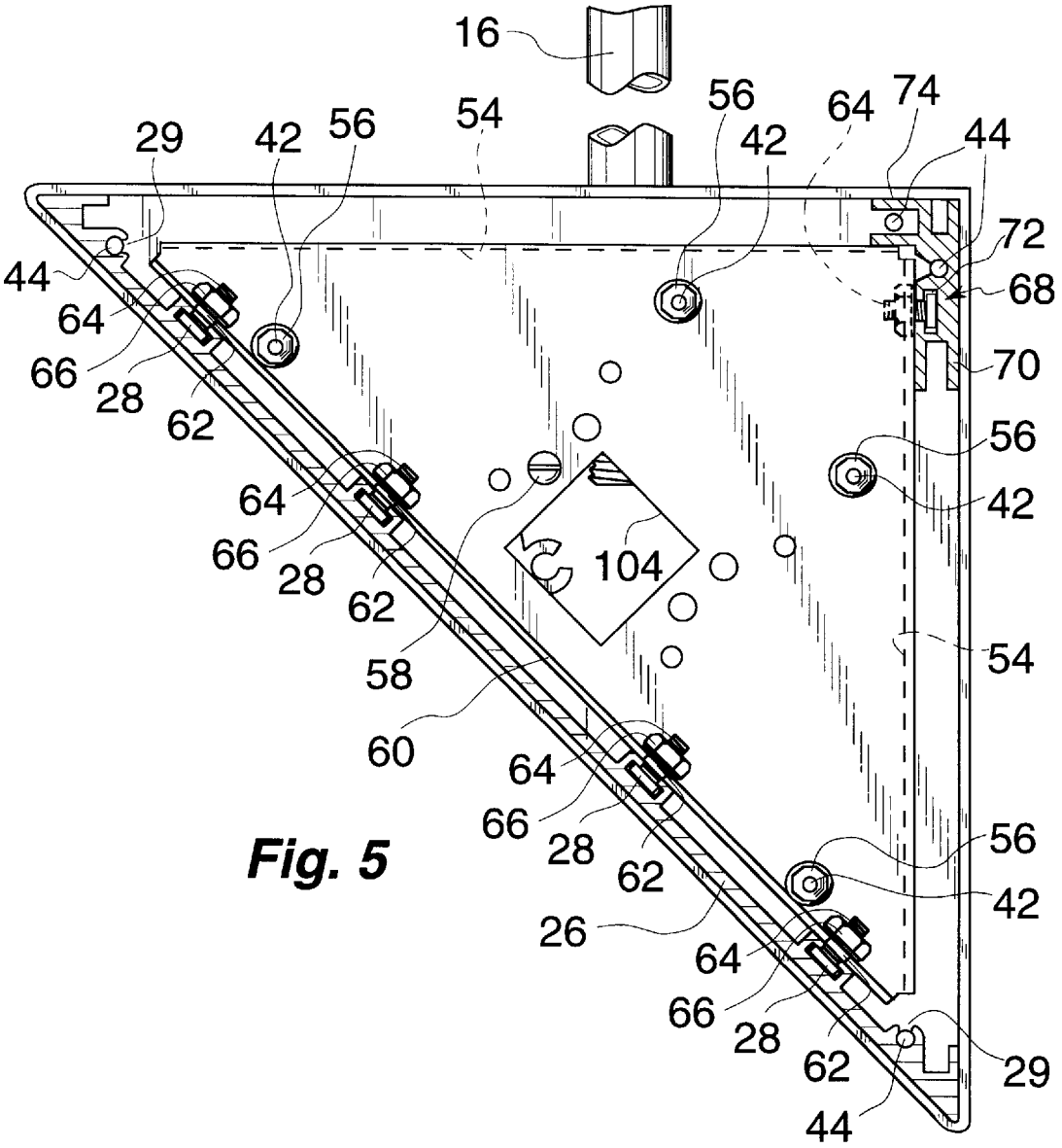
FIG. 5 is an enlarged scale sectional view through the housing partially assembled, the same being taken substantially along a plane 5—5 of FIG. 3 and showing the chassis mounted to the end plate and to the base and a stringer mounted to the chassis.

Projecting inwardly from each end plate 30 is a peripheral lip 40, a plurality of posts 42, having enlarged shoulder stops and a plurality of mounting pins 44, located adjacent the corners of the end plate. Only the right end plate is illustrated in FIG. 4, with the left end plate being a mirror image. Spaced from and extending parallel with a hypotenuse edge of the end plate 30 are a plurality of rectangular tangs 46 which seat within the rectangular channels 28 on the inner face of the base 26 when the housing 14 is assembled. Simultaneously, the channels 29 engage the pins 44. When the housing 14 is assembled, the base 26 lies in a plane at an angle of approximately 45° from horizontal.

The collar 34 extends through the end plate aperture 32 a distance equal to the length of the shoulder stops of the posts 42. Positioned against the shoulder stops and against the end of the collar 34 is a right angle chassis 50.

The chassis 50 is generally planar and may be formed of sheet metal. From an observation of FIG. 3, it will be noted that the chassis 50 includes a pair of generally planar side edge flanges 54 which extend from the plane of the chassis toward the end plate to a depth equal to the length of the shoulder stops. One of the flanges 54 lies in a vertical plane and the other, in a horizontal plane.

The chassis 50 includes a plurality of apertures registered with the portions of the posts 40 extending beyond the shoulder stops. The chassis is placed against and abuts the shoulder stops and the end of the collar 34 and is secured in such position by self tapping nuts 56 which are engaged over the posts 42 as well as a self tapping screw 58 which is engaged in one of the collar channels 36.

Figure 3:
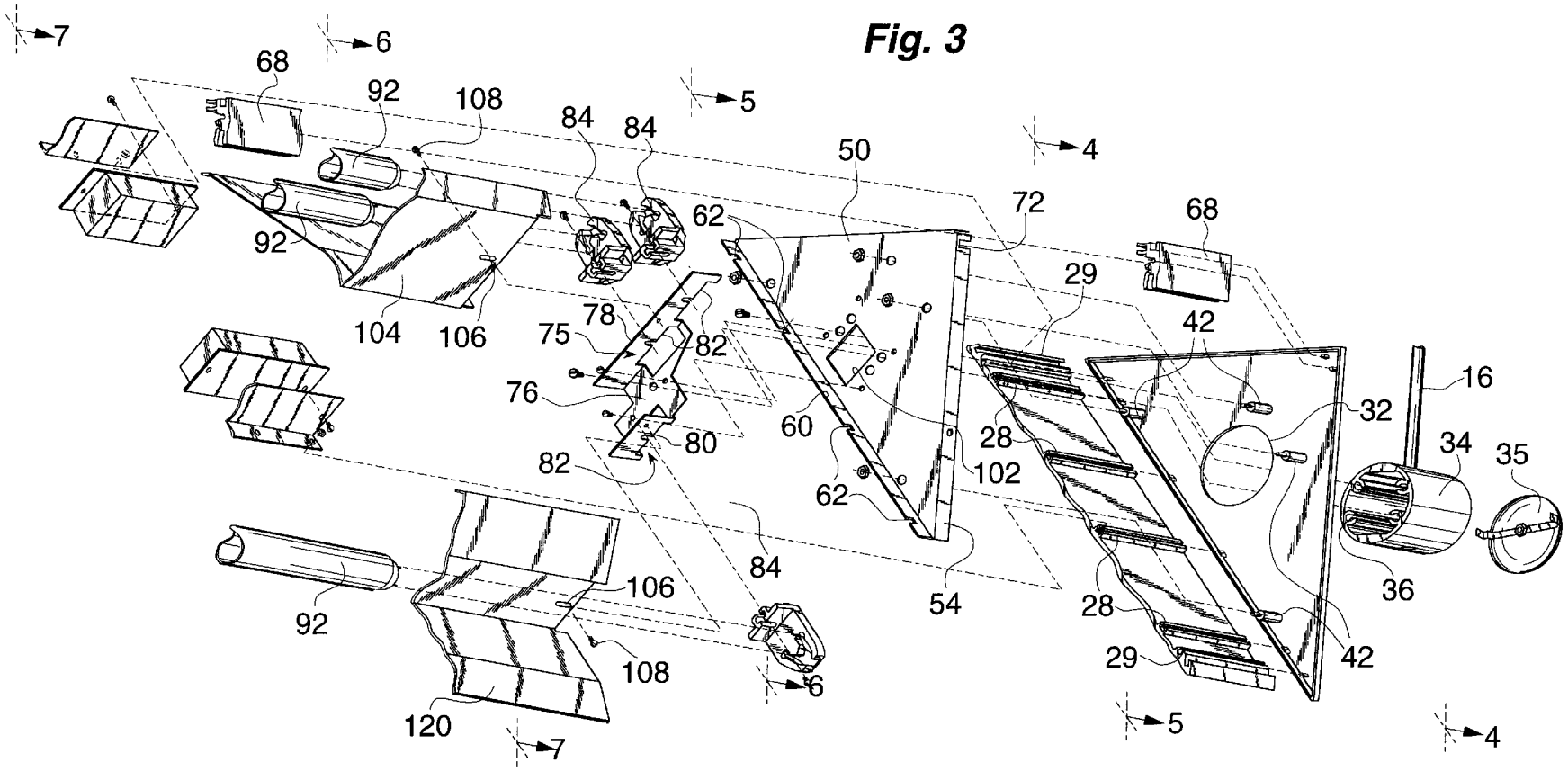
FIG. 3 is an exploded fragmentary perspective view of a light housing in accordance with the invention and illustrating a base, an end plate, a chassis and a bracket configured to carry a pair of asymmetric reflectors as well as light sockets.

FIG. 3 also reveals that the chassis 50 includes a generally rectangular hypotenuse flange 60 which extends perpendicular to the plane of the chassis 50 in a direction facing the interior of the fixture housing 14. The hypotenuse flange 60 includes a plurality of cut out notches 62 which are registered with the rectangular channels 28 of the base 26. Seated in each of the rectangular channels 28 is the head of a bolt 64 which projects from the channel. The bolts 64 are positioned so that they extend through the notches 62 and a nut 66, carried on each bolt 64 is then tightened to bear down and compress the hypotenuse flange 60 against the tops of the channels 28 thus securing the base 26 to the end plate 30.

The housing 14 also includes an extruded metal stringer beam 68 having a length equal to the length of the base and which spans between the opposed end plates 30 at their mutual right angle corners to structurally integrate the housing 14. The stringer 68 beam includes a vertically oriented rectangular section 70 having a thickness which is substantially the same as the distance between the peripheral flange 40 of the end plate 30 and the vertical side edge flange 54 and is seated therebetween. The rectangular section 70 of the stringer 68 includes an inwardly facing rectangular channel 72 within which is seated the head of a further bolt 64. The further bolt 64 extends through a notch 72 (illustrated in FIG. 3) of the vertical flange 54. A nut 66, engaged on the further bolt 64, tightens the flange 54 against the stringer beam 68 prior to mounting the chassis 50 to the end plate 30. The rectangular section 70 also includes a "C" shaped channel which is received around one of the locating pins 44 adjacent the right angle corner of the end plate 30.

The stringer beam 68 also includes a horizontal section 74 dimensioned to be received between the peripheral lip 40 and the horizontal side edge flange 54. The section 74 includes a rectangular channel which seats around a further mounting pin 44.

In accordance with the invention, a sheet metal bracket 75 of generally "U" shaped cross section is mounted to the inner face of the chassis 50 and serves to carry electrical sockets for lighting sources or elements as well as asymmetric reflectors. The bracket 75 comprises a generally planar web 76, a perpendicular up light side edge flange 78 and a wall wash side edge flange 80 which extends parallel to the up light side edge flange 78. The chassis 50 and bracket 75 associated with the left end plate are mirror images of those illustrated in the drawing figures.

The up light side edge flange 78 and a registered web area include a pair of notches 82 through which are received conventional sockets 84, secured in a conventional manner with machine screws and nuts. A pair of sockets 84 may the mounted to the up light flange 78, however, in certain applications a single socket is mounted to each up light flange. Similarly, the wall wash flange 80 and a registered web area includes a notch 82 which receives a further socket 84.

During assembly of the fixture housing 14, the sockets 84 are mounted to the bracket 75. Thereafter, the bracket 75 is secured to the chassis 50 with a pair of screws 88, extending through registered openings in the web 76 and the chassis 50. If the bracket 75 is mounted to the chassis prior to mounting the chassis to the end plate 30, machine screws may be utilized and with mating nuts secured against the opposite face of the chassis. If the bracket 75 is mounted to the chassis subsequent to mounting of the chassis to the end plate, self taping screws may be employed as well as other conventional blind fasteners, such as pop rivets. Additionally, an aperture of the web 76 is registered with an aperture of the chassis as well as one of the collar channels 36. Through such registered apertures, an enlarged self tapping screw 90, similar to the screw 58, is engaged.

In accordance with the invention, assembly of the fixture housing 14 next entails the mounting of power supplies for linear lighting sources 92 (FIG. 3) which are carried between opposed facing fixtures 84 at the opposite ends of the housing 14. In this regard, a pair of angle irons 94, formed of sheet metal, may be employed. The angle irons extend substantially the entire length of the base 26, from the inwardly facing edge of the hypotenuse flange 60 adjacent one end plate to the inwardly facing edge of the hypotenuse flange of the opposite end plate.

Each angle iron 94 includes a short flange 96 which is positioned to lie over one of the two inner rectangular channels 28. A plurality of spaced apertures are provided through the flanges 96 and bolts 64, seated in the channels 28 are registered with the apertures. Nuts 66 are engaged over the bolts to tighten the flange 96 against the rectangular channels 28. As such, the angle irons 94 serve to stiffen the base 26.

The remaining flange 98 of the angle iron 94 includes openings adapted to receive a bolt 64 having a nut 66 with the screw extending through a registered aperture in an end flange of a suitable ballast 100. One of the ballasts 100 is electrically wired to the socket 84 mounted to the wall wash flange 80 at opposite ends of the housing 14 while the other ballast is electrically wired to the sockets 84 which are mounted to the up light flanges 78. Suitable wiring from an outlet box in the ceiling through one of the stems 16, into the connector collar 34 and through a square aperture 102 of the chassis 50 is provided to energize the ballasts 100 either simultaneously or selectively.

An elongate asymmetric up light reflector 104 is fabricated of sheet metal, for example and is preferably coated on its outwardly facing surface with a white enamel finish having a reflectance in the order of 90%. The up light reflector 104 is of a length sufficient to span between and overlie the up light flanges 78. As will be noted from an observation of FIG. 3, the reflector 104 includes a cutout portion at its end to avoid interference with the sockets 84. The up light reflector 104 includes an aperture 106 adjacent each of its ends for securement against the up light flanges 78 through the use of a suitable fastener, such as a machine screw and nut 108, 110.

Figures 6, 7:
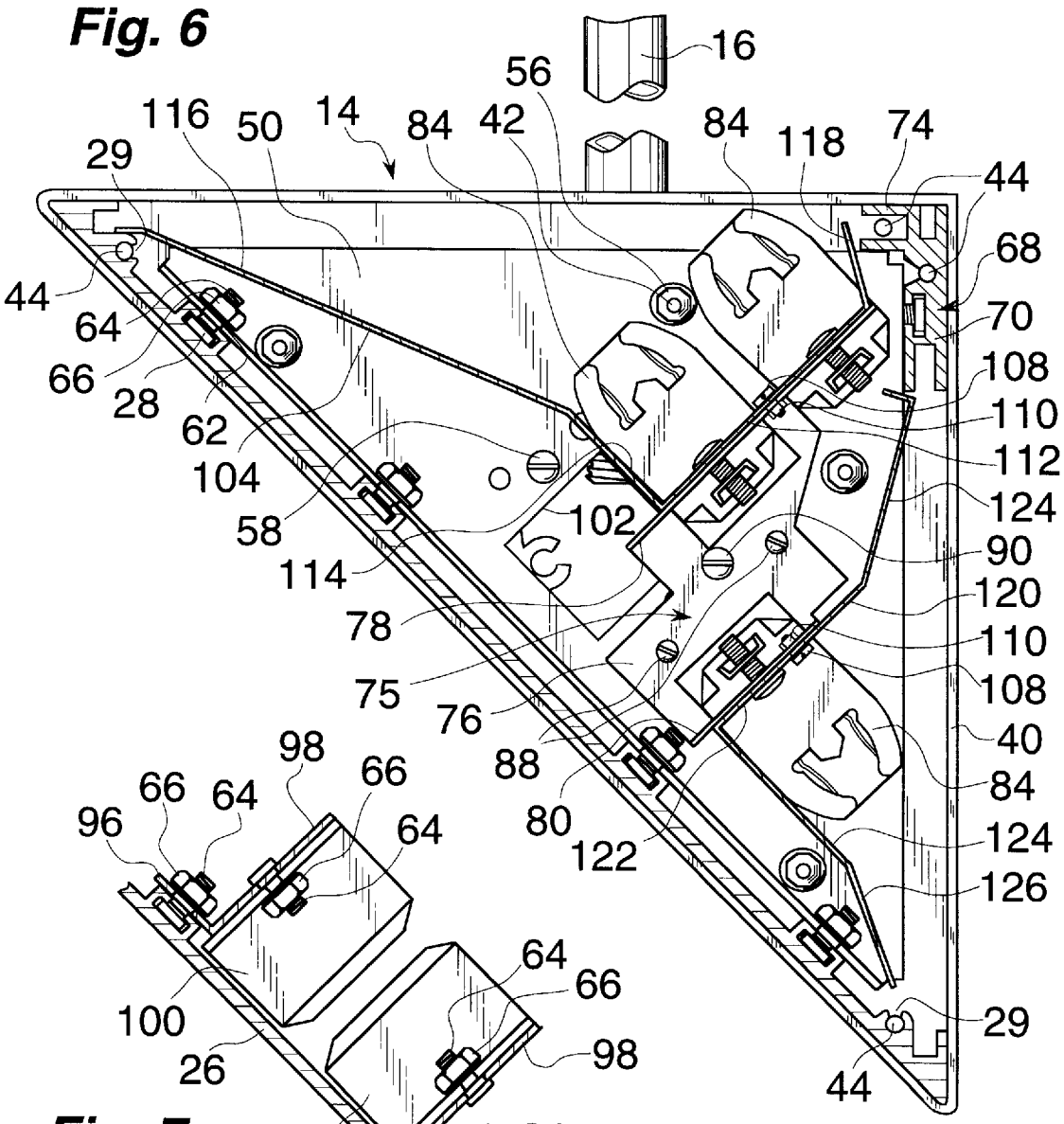
FIG. 6 is an enlarged scale sectional view through the housing, the same being taken substantially along a plane 6—6 of FIG. 3 with portions deleted for clarity and showing the bracket in more detail and the manner in which the reflectors are secured to the bracket.
FIG. 7 is a fragmentary further enlarged scale sectional view through the housing taken along a plane 7—7 of FIG. 3, with portions deleted for clarity and illustrating a pair of ballasts, each mounted to an angle iron which, in turn, is mounted to the base.

From an observation of FIG. 6, wherein the reflector 104 is shown in transverse cross section, it should be noted that the reflector 104 includes a generally planar portion 112 positioned at an angle of 45 degrees from a horizontal plane and which underlies the sockets 84 and the lighting element 92. Adjacent the lowermost socket 84, the up light reflector 104 includes a leg portion which is bent in a direction substantially perpendicular to the central portion 112 and extends at an angle of approximately 135 degrees from a horizontal plane upwardly, toward to the ceiling and away from the wall 20, to a fold line which is substantially at a point adjacent the circumference of a linear lighting 92 element carried in the lowermost socket 84. From the fold line, the up light reflector 104 extends along a major reflective panel portion 116 at an angle of approximately 158° from a horizontal plane to substantially the upper distal edge of the base 26.

From the opposite longitudinal fold line of the central portion 112, the up light reflector includes a planar flange portion 118 which extends upwardly to the channel formed in the rectangular section 74 of the stringer beam 68 at an angle of approximately 105 degrees from a horizontal plane.

The lighting elements, combined with the up light reflector function to radiate illumination upwardly through a housing opening or window lying in a horizontal plane and formed by the uppermost longitudinal edge of the base 26, the longitudinal edge of the stringer beam section 74 and the end plates 30.

A wall wash reflector 120 is also formed of sheet metal and extends between opposed wall wash flanges 80. The wall wash reflector 120 lies behind a lighting element 92 carried between the sockets 84 of the wall wash flanges 80. A central portion 122 includes slotted mounting apertures 106 and is oriented at an angle of approximately 45 degrees from a horizontal plane. The central portion 122 extends upwardly toward the wall 20 to a fold line from which a reflective portion 124 extends at an angle of approximately 75 degrees from a horizontal plane for directing illumination against the wall 20. The reflective portion 124 extends to the longitudinal edge of the stringer beam section 70.

From an opposite longitudinal fold line of the central portion 122, the wall wash reflector includes a reflective portion 124 which extends perpendicularly and at an angle of approximately 315 degrees from a horizontal plane, downwardly toward the floor of the room 12 and along the side of a lighting element 92 to reflect illumination upwardly against the wall 20. The reflective portion 124 extends to a fold line from which a depending planar lip portion 126 is provided. The lip portion 126 extends to substantially the lower edge of the base 26 at an angle of approximately 290 degrees from a horizontal plane to direct wall wash illumination upwardly, while the central portion 122 and the portion 124 reflect wall wash illumination downwardly, toward the portion of the wall 20 beneath the elevation of the housing 14.

The lighting element, combined with the wall wash reflector function to radiate illumination against the wall 20 both above and below the elevation of the housing 14 through a window lying in a vertical plane and formed by the lower longitudinal edge of the base 26, the longitudinal edge of the stringer beam section 70 and the vertical side edges of the end plates 30.

Figure 2:
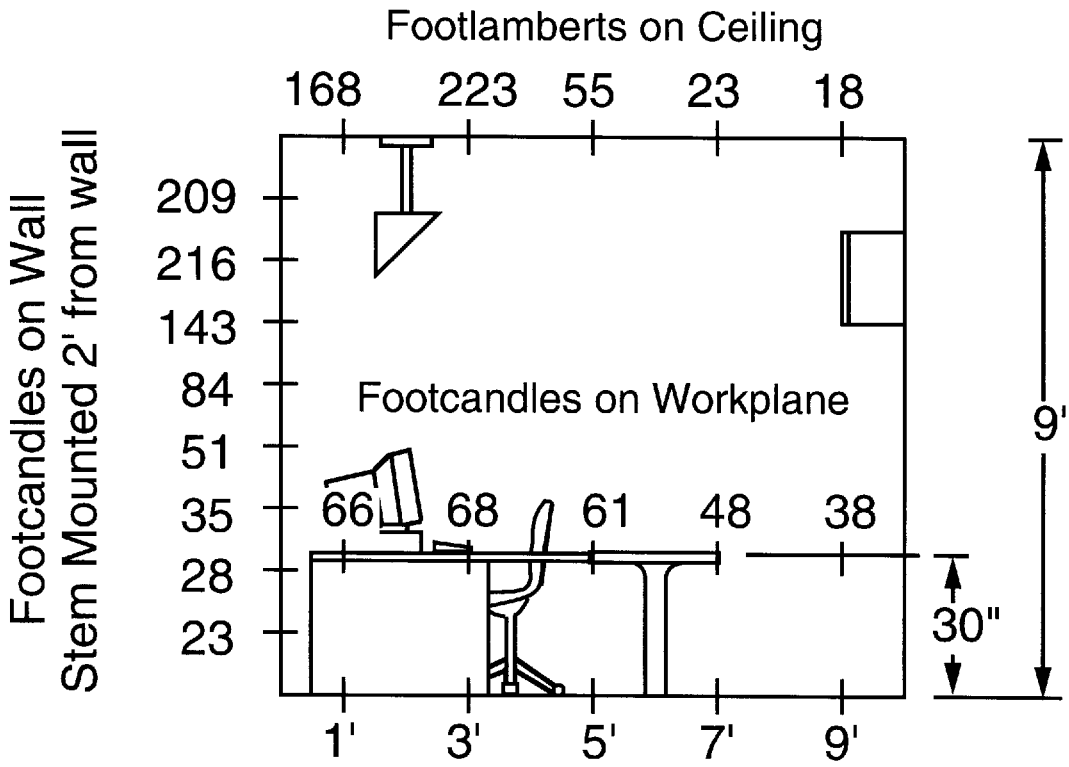
FIG. 2 is an auxiliary elevational view of the room, taken substantially along a plane 2—2 of FIG. 1 and schematically illustrating a work surface and graphically depicting measurements of surface luminance at the ceiling and surface illuminance at an adjacent wall and at a plane of the work surface.

The overall arrangement of components provides a highly efficient, compact assembly. For example, the ballasts 100 are mounted to the base 26 beneath the up light reflector 104 and behind the central portion 122 of the wall wash reflector 120. Further, the lighting system 10 is particularly well adapted for high efficiency low energy consumption. In this regard, the lighting system 10 may employ, for example, F32 T8 fluorescent lamps as the lighting sources 92 and Class "P" energy saving rapid start 265 ma electronic ballasts as the power supplies. Utilizing two T8 lamps for up light illumination and one T8 lamp for down light illumination, the performance data depicted in FIG. 2 was obtained for a room 12 measuring 10 feet by 15 feet, with a light fixture length of 8 feet 8 inches, a stem mounting length of 1 foot, 6 inches and a ceiling height of 9 feet wherein the ceiling reflectance was 80%, the wall reflectance 50% and the floor reflectance 20%.

With the lighting system 10 identically configured except that only one pair of sockets was mounted to the up light flange of the brackets, and with such sockets being mounted in the uppermost position (upper right as viewed in FIG. 6), higher overall efficiency was attained, with reduced surface luminance values across the ceiling, ranging from 123 footlamberts one foot from the wall 20, 163 footlamberts at 3 feet, 40 footlamberts at 5 feet, 17 footlamberts at 7 feet and 13 footlamberts at 9 feet. The illuminance values across the wall 20 ranged from 153 footcandles at 1 foot from the ceiling, 158 footcandles at 2 feet from the ceiling, 104 footcandles at 3 feet from the ceiling, 61 footcandles at 4 feet from the ceiling to 17 footcandles 1 foot from the floor. The work plane illuminance values were 48 footcandles, one foot from the wall, 49 footcandles 3 feet from the wall, 44 footcandles 5 feet from the wall, 35 footcandles 7 feet from the wall, and 28 footcandles 9 feet from the wall.

It should be understood that the invention has been shown and described in an exemplary manner and various modifications might be made without departing from the spirit of the invention. For example, the fixture housing need not be of triangular transverse cross section, the windows need not be separately defined by the stringer and various other alternate modes of construction and arrangements may be employed, and the invention should not be considered to be limited to the specific lighting sources and power supplies set forth as exemplary.

Thus it will be seen that there is provided a bidirectional lighting system which achieves the various considerations, features and aspects of the present invention and which is well suited to meet the conditions of practical usage.

Having thus described the invention, there is claimed as new and desired to be secured by Letters Patent:

1. A bidirectional lighting system for use in illuminating a room, the lighting system comprising:

(a) a fixture housing, (b) means for mounting the housing in the room at an elevation beneath a ceiling surface and at a location adjacent to and spaced from a wall surface, (c) an up light source, (d) means for energizing the up light source operatively connected to the up light source, (e) means for mounting the up light source within the housing in an operative position for emitting light radiation upwardly toward the ceiling, (f) up light reflector means mounted within the housing for reflecting light radiation only from the up light source toward the ceiling surface, (g) a wall wash light source, (h) means for energizing the wall wash light source operatively connected to the wall wash light source, (i) means for mounting the wall wash light source within the housing in an operative position for emitting light radiation toward the adjacent wall surface, and (j) wall wash reflector means mounted within the housing for reflecting light radiation only from the wall wash light source toward the adjacent wall surface and for distributing the reflected light radiation on the adjacent wall surface above, below and at the elevation of the housing, the light radiation emitted from the wall wash light source and the light radiation reflected from the wall wash reflector means providing uninterrupted wall wash illumination, whereby the room is supplied with both up light ceiling illumination and wall wash illumination.

2. A bidirectional lighting system as constructed in accordance with claim 1 wherein the wall wash light source is a linear light source, the wall surface being generally planar, the wall wash light source being mounted along an axis parallel to the plane of the wall surface.

3. A bidirectional lighting system as constructed in accordance with claim 1 wherein the up light source and the wall wash light source are fluorescent light sources.

4. A bidirectional lighting system as constructed in accordance with claim 1 wherein the means for energizing the up light source comprises ballast means and the means for energizing the wall wash light source comprises ballast means.

5. A bidirectional lighting system as constructed in accordance with claim 1 wherein the up light reflector means comprises an asymmetric reflector, the up light source being positioned between the asymmetric reflector and the ceiling.

6. A bidirectional lighting system as constructed in accordance with claim 1 wherein the wall wash reflector means comprises an asymmetric reflector, the wall wash light source being positioned between the asymmetric reflector and the wall surface.

7. A bidirectional lighting system as constructed in accordance with claim 6 wherein the up light reflector means comprises an asymmetric reflector, the up light source being positioned between the up light reflector means and the ceiling.

8. A bidirectional lighting system as constructed in accordance with claim 1 wherein the fixture housing includes a first window generally facing the ceiling and a second window generally facing the wall surface, the up light source and the up light reflector means being registered with the first window and the wall wash light source and the wall wash reflector means being registered with the second window.

9. A bidirectional lighting system as constructed in accordance with claim 8 wherein the fixture housing includes an elongate base and a pair of end plates, the base spanning between the end plates, the fixture housing further including a stringer, the stringer spanning between the end plates, the base having a first longitudinal edge and a second longitudinal edge, the first window being defined by the stringer and the first longitudinal edge of the base and the second window being defined by the stringer and the second longitudinal edge of the base.

10. A bidirectional lighting system as constructed in accordance with claim 9 wherein the base is generally planar.

11. A bidirectional lighting system as constructed in accordance with claim 1 wherein the up light source comprises a plurality of light sources, the means for energizing the up light source being operatively connected to each light source of the plurality of light sources, and the up light reflector means including means for reflecting light radiation from each light source of the plurality toward the ceiling.

12. A bidirectional lighting system as constructed in accordance with claim 1 wherein the fixture housing includes an elongate base and a pair of end plates, the base spanning between the end plates, the fixture housing further including a stringer, the stringer spanning between the end plates, the housing further including a chassis associated with each end plate, means interconnecting each chassis with its associated end plate, means interconnecting each chassis to the base and means interconnecting each chassis and the stringer.

13. A bidirectional lighting system as constructed in accordance with claim 1 wherein the fixture housing includes an elongate base and a pair of end plates, the base spanning between the end plates, the fixture housing further including a stringer, the stringer spanning between the end plates, the housing further including a chassis associated with each end plate, means fixing each chassis to its associated end plate, bracket means for supporting the up light reflector means and for supporting the down light reflector means, and means fixing the bracket means to the chassis.

14. A bidirectional lighting system as constructed in accordance with claim 13 wherein the means for energizing the up light source and the means for energizing the wall wash light source comprise electrical sockets, the housing further including means for mounting the up light source electrical sockets and the wall wash light source electrical sockets to the bracket means.

15. A bidirectional lighting system as constructed in accordance with claim 14 wherein the bracket means is formed of one piece construction.

16. A bidirectional lighting system as constructed in accordance with claim 1 wherein the fixture housing includes a planar base, the base having an exterior face and an interior face, channel means on the interior face of the base, the means for energizing the up light source and the means for energizing the wall wash light source comprising separate power supplies and means for mounting the up light source power supply and the wall wash light source power supply to the channel means.

17. A bidirectional lighting system for use in illuminating a room as constructed in accordance with claim 16 wherein the means for mounting the up light source power supply and the wall wash light source power supply comprises angle iron means, fastener means extending between the channel means and the angle iron means at spaced locations along the base and fastener means extending between the angle iron means and each power supply, whereby the base is structurally reinforced.

18. A bidirectional lighting system fixture for a room, the room having a ceiling surface, a floor surface and a wall surface, the fixture including a housing, means for mounting the fixture within the room at a location spaced from the ceiling surface and spaced from the wall surface, the housing having a first window means facing the ceiling surface for defining a light passage for transmission of light upwardly against the ceiling surface, the housing having a second window means facing the wall surface for defining an unobstructed light passage for transmission of light against the wall surface, the wall surface having a height extending substantially from the ceiling surface to the floor surface, an up light source associated with the first window means, a first asymmetric reflector means associated with the up light source and the first window means for directing light only from the up light source through the light passage of the first window means toward the ceiling surface, a wall wash light source associated with the second window means, a second asymmetric reflector means associated with the wall wash light source and the second window means for directing light only from the wall wash light source through the light passage of the second window means toward a wall surface and for distributing light from the wall wash light source the continuously over the entire height of the wall surface.

19. A lighting system for illuminating a room, the lighting system comprising an elongate housing, the housing including a substantially planar base and a pair of substantially planar end plates lying in planes perpendicular to the plane of the base, the housing further including substantially planar chassis means associated with each end plate for interconnecting the base to the associated end plate, means fixing the chassis means to each end plate, the chassis means including a flange extending perpendicular to the plane of the chassis, the base including an internal channel, the flange including an aperture in registration with the channel, the housing including fastener means projecting from the channel through the aperture, the fastener means securing the flange to the base.

20. A lighting system as constructed in accordance with claim 19, the housing further including a stringer, the stringer spanning between the end plates and means securing the stringer to each chassis means.

* * * * *